US008316609B2

(12) United States Patent
Ben-Zvi

(10) Patent No.: US 8,316,609 B2
(45) Date of Patent: Nov. 27, 2012

(54) MODULAR PANEL UNITS FOR CONSTRUCTIONAL PURPOSES

(75) Inventor: Nir Ben-Zvi, Upper Galilee (IL)

(73) Assignee: Dan-Pal, Upper Galilee (IL)

( * ) Notice: Subject to any disclaimer, the term of this patent is extended or adjusted under 35 U.S.C. 154(b) by 0 days.

(21) Appl. No.: 12/452,009

(22) PCT Filed: Jun. 12, 2008

(86) PCT No.: PCT/IL2008/000798

§ 371 (c)(1),
(2), (4) Date: Jan. 25, 2010

(87) PCT Pub. No.: WO2008/152637

PCT Pub. Date: Dec. 18, 2008

(65) Prior Publication Data

US 2010/0126099 A1 May 27, 2010

(30) Foreign Application Priority Data

Jun. 13, 2007 (IL) ..... 183898

(51) Int. Cl.
*E04H 9/16* (2006.01)
*E04H 9/14* (2006.01)

(52) U.S. Cl. ..... 52/582.1; 52/459; 52/461; 52/463; 52/464

(58) Field of Classification Search ..... 52/582.1, 52/200, 459, 460, 461, 463, 464, 470, 584.1
See application file for complete search history.

(56) References Cited

U.S. PATENT DOCUMENTS

| | | | | |
|---|---|---|---|---|
| 3,363,383 | A | 1/1968 | La Barge | |
| 4,075,811 | A * | 2/1978 | Keith | 52/395 |
| 4,402,168 | A * | 9/1983 | Maier, Jr. | 52/478 |
| 4,573,300 | A * | 3/1986 | Bezner | 52/563 |
| 4,790,112 | A | 12/1988 | Wang | |
| 4,998,395 | A * | 3/1991 | Bezner | 52/563 |
| 5,348,790 | A * | 9/1994 | Ben-Zvi et al. | 428/178 |
| 5,901,528 | A | 5/1999 | Richardson | |

(Continued)

FOREIGN PATENT DOCUMENTS

EP 0 835 968 4/1998

(Continued)

OTHER PUBLICATIONS

International Search Report for PCT/IL2008/000798 mailed Oct. 23, 2008.

(Continued)

*Primary Examiner* — Mark Wendell
(74) *Attorney, Agent, or Firm* — Smith, Gambrell & Russell, LLP

(57) ABSTRACT

A panel unit (2) for constructional purposes has at least two joining flanges (10, 12) on opposite surfaces (4, 4') located at, or adjacent to, a common edge of the panel unit, and projecting in mutually opposite directions. Two such panel units (2) may be juxtaposed end to end and secured by a two-part connector (17) having a base portion (18) that is adapted for attaching to a fixed structural element (20) and for anchoring to the flanges (12) on a first surface (4') of the panel units 2, and a cap (19) adapted for anchoring to the flanges (10) on an opposite surface (4) of the panel units (2) and for anchoring to the base portion.

29 Claims, 3 Drawing Sheets

U.S. PATENT DOCUMENTS

| | | | | |
|---|---|---|---|---|
| 5,966,888 | A * | 10/1999 | Richardson | 52/580 |
| 6,023,899 | A * | 2/2000 | Mecozzi | 52/396.04 |
| RE36,976 | E * | 12/2000 | Bezner | 52/563 |
| 6,164,024 | A * | 12/2000 | Konstantin | 52/200 |
| 6,202,382 | B1 * | 3/2001 | Conterno | 52/762 |
| 6,298,627 | B1 | 10/2001 | Richardson | |
| 6,347,495 | B1 | 2/2002 | Conterno | |
| 6,536,175 | B2 * | 3/2003 | Conterno | 52/489.1 |
| 7,926,236 | B2 * | 4/2011 | Konstantin | 52/466 |
| 8,056,289 | B1 * | 11/2011 | Konstantin | 52/204.591 |
| 2001/0005963 | A1 | 7/2001 | Richardson | |
| 2004/0261336 | A1 * | 12/2004 | Konstantin | 52/200 |
| 2009/0049770 | A1 * | 2/2009 | Konstantin | 52/200 |
| 2009/0293241 | A1 * | 12/2009 | Voegele, Jr. | 24/457 |
| 2010/0242397 | A1 * | 9/2010 | Givoni et al. | 52/588.1 |
| 2010/0287858 | A1 * | 11/2010 | Israeli et al. | 52/220.7 |
| 2012/0151867 | A1 * | 6/2012 | Smith et al. | 52/588.1 |

FOREIGN PATENT DOCUMENTS

| | | |
|---|---|---|
| EP | 0 864 708 | 9/1998 |
| EP | 0 949 390 | 10/1999 |
| FR | 2 850 993 | 8/2004 |
| GB | 2 115 452 | 9/1983 |
| GB | 2 335 210 | 9/1999 |
| GB | 2 351 095 | 12/2000 |
| GB | 2 397 591 | 7/2004 |
| WO | 91/04380 | 4/1991 |

OTHER PUBLICATIONS

International Search Report for PCT/IL2008/000746 mailed Nov. 7, 2008 (w/ English language translation).

* cited by examiner

MODULAR PANEL UNITS FOR CONSTRUCTIONAL PURPOSES

FIELD OF THE INVENTION

The present invention relates to modular panel units for the construction of walls, ceilings, roofs, canopies and windows, particularly of light-transmitting wall sections. More specifically, the present invention relates to such panel units having joining-flanges at their ends and being manufactured by extrusion.

BACKGROUND OF THE INVENTION

Extruded modular panel units of the type of the present invention are known, for example, from the U.S. Pat. Nos. 4,573,300, 4,998,395 and 5,348,790, the teachings of which are incorporated herein by reference.

In all of these patents, there are disclosed panel units having two interconnected, spaced-apart major surfaces and a joining flange at each of its ends, both flanges projecting at the same direction from a single major surface of the panel.

While such panels have been used to advantage for many years, it has been found that in some instances under adverse weather conditions, difficulties may be created with respect to waterproofing and withstanding strong winds, especially with a structure composed of two parallel disposed panel units interconnected by H-shaped connectors.

SUMMARY OF THE INVENTION

It is therefore a broad object of the present invention to ameliorate the disadvantages of the above-described panel units and to provide panel units rendering the construction sturdier to weather conditions.

In accordance with the present invention there is therefore provided a panel unit for constructional purposes, comprising at least two joining flanges on opposite surfaces located at, or adjacent to, a common edge of the panel unit and projecting in mutually opposite directions.

BRIEF DESCRIPTION OF THE DRAWINGS

In order to understand the invention and to see how it may be carried out in practice, embodiments will now be described, by way of non-limiting example only, with reference to the accompanying drawings, in which.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF EMBODIMENTS

Figure 1:
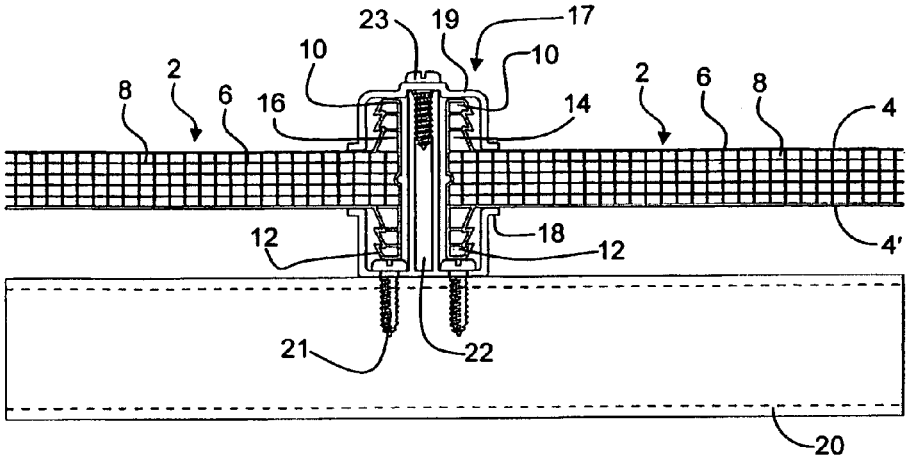
FIG. 1 is a cross-sectional view of a first embodiment of connected panel units, according to the present invention.

FIG. 1 shows two juxtaposed and interconnected panel units 2 for constructional purposes, according to an embodiment of the invention. Typically, such panel units are manufactured by extrusion. Each of the panel units includes two major surfaces 4, 4', interconnected by a plurality of ribs 6 and/or intermediate surfaces 8, dividing the space defined between the major surfaces into a plurality of sub-spaces. Each of the panel units has at least two joining flanges 10, 12, located at, or adjacent to, a common edge of the respective panel unit 2. Each of the flanges 10, 12 in the respective panel unit projects from a different major surface 4 or 4' of the panel unit 2. Although not shown in the figure, typically one of the two flanges projects from one major surface and two flanges project from the other major surface. The flanges may project from the major surfaces at right angles, or at a non-normal angle thereto; they may be aligned with another flange at the same edge of the panel unit, or be staggered or stepped with respect to an adjacent flange.

While the panels illustrated in all of the figures herein are of the type described above, it is to be noted that the present invention also encompasses other types of constructional panels, with or without sub-spaces included between the major surfaces. For example, the present invention encompasses panels which define a plurality of spaces formed by partitions extending transversely between the major surfaces, and panels of a type in which material fills out the entire space in between the major surfaces, as well as the interior of the flanges.

The flanges themselves, as will also be described below, may be of all kinds of configurations and may or may not include detents for engaging and gripping compatible detents made in panel unit connectors. In the embodiment of FIG. 1, the flanges 10, 12 have wider base portions 14, 16 than the remaining portion, providing improved support. In accordance with the embodiment shown in FIG. 1, the flanges 10, 12 are of equal height and, in assembly, the two juxtaposed panel units 2 are inter-connected by a two-part connector 17 having a base portion 18 that is anchored to the flanges 12 on the lower surface of the panel units 2 and is anchored to the flanges 10 on the upper surface of the panel units 2 by a cap 19. The base portion 18 is fixedly attached to a fixed structural element 20, e.g., a roofs beam e.g., by screws 21. A cylindrical bore 22 of height substantially equal to the combined height of the panel units 2 plus the two flanges 10 and 12 projects upwards from the center of an internal surface of the base portion. The downwardly projecting flanges 12 of the panel units 2 are inserted into the base portion 18 so that the cylindrical bore 22 protrudes out of the upper surface. The cap 19 is now mounted over the upwardly projecting flanges 10 of the juxtaposed panel units 2 and is anchored to the base portion 18 via a screw 23 that engages an internal thread of the cylindrical bore 22. The screw 23 may be self-tapping and the connector may take any practical and aesthetical configuration and be made of plastic or metal. In the illustrated configuration, the base portion 18 from an inside surface of which there. The dimensions of the base portion 20 and the bore 22 are such as to leave a gap between the outer surface of the bore 22 and the end surfaces of the panel units so as to allow for thermal expansion and contraction of the panel units 2.

Figure 2:
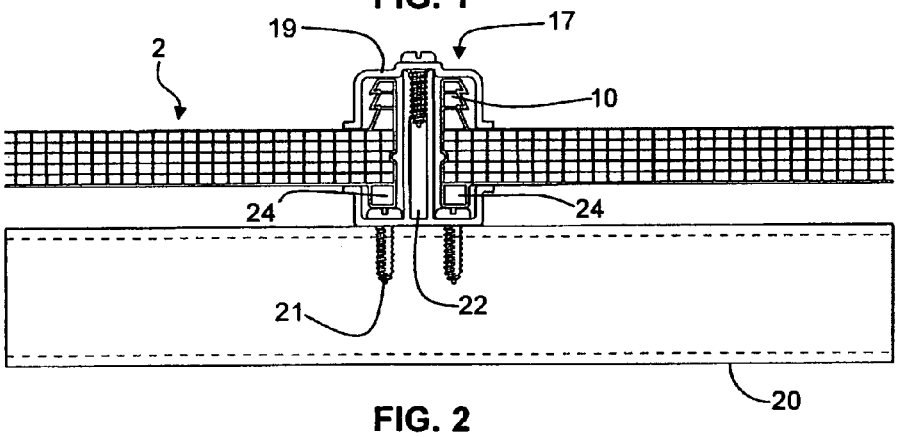
FIG. 2 is a cross-sectional view of a second embodiment of connected panel units according to the present invention.

FIG. 2 shows is a variation of this embodiment in which the height of the flanges 24 on lower surface of the panel unit 2 is different from that of the flanges 10 on the upper surface. The same connector type, however, is used with different proportions on each side of the panel unit 2. In the figure, the lower flanges 24 are smaller than the upper flanges 10, but the reverse is also contemplated.

The construction according to both variations is watertight, withstands strong winds and allows for the thermal expansion and contraction of the panel units.

Figure 3:
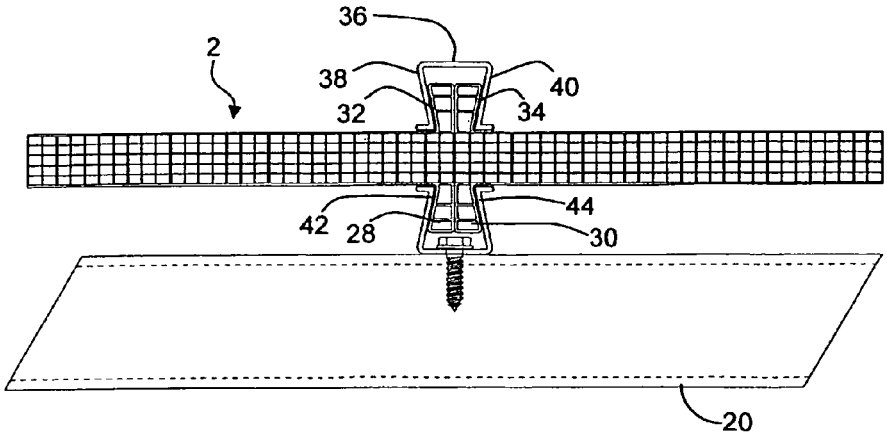
FIG. 3 is a cross-sectional view of a third embodiment of connected panel units according to the present invention.

FIG. 3 illustrates flanges 28, 30 of panel units 2, which have slanting inner surfaces 32, 34, and correspondingly, the connector 36 has complementary slanting legs 38, 40. The slanting surfaces of the flanges and of the connector, in effect provide detents, preventing the dislodgement of the panel units 2. Naturally, saw-tooth or other known detents with compatibly configured connector legs can be used. Such a connector 36 can also be configured with wider horizontal dimensions to provide suitable clearance for thermal expansion.

It should be understood that while typically the panel units 2 are manufactured with symmetrical flanges on both edges, for special structures and for a special end surface finish, there may be formed asymmetrical panel units with different flange configurations on selected edges.

Figure 4:
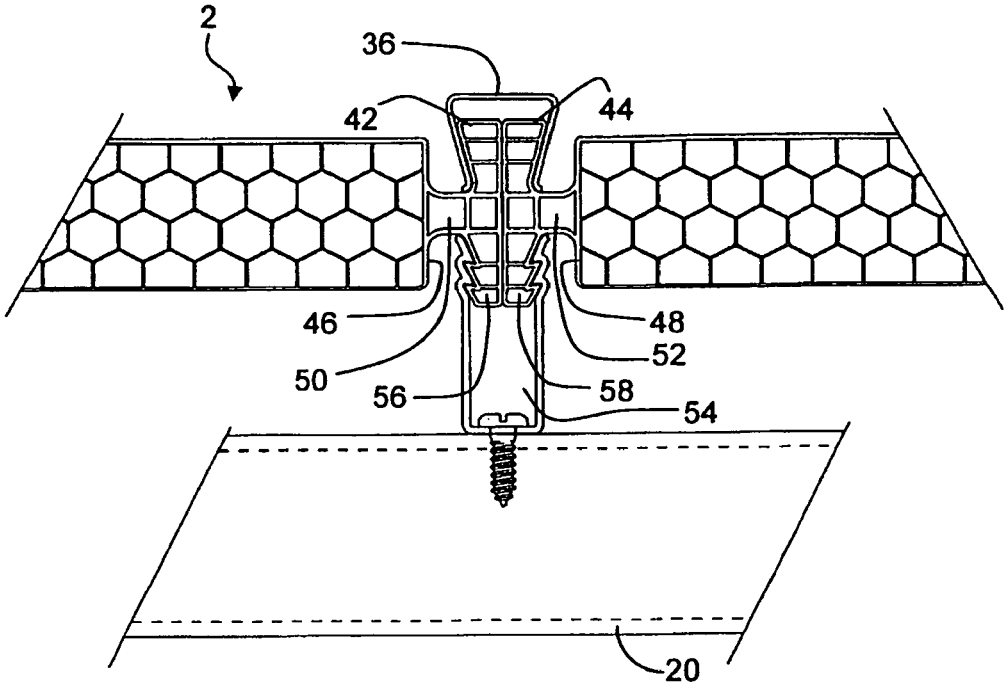
FIGS. 4 and 5 are cross-sectional views of further embodiments of connected panel units according to the present invention.

FIG. 4 shows a double-flanged panel unit 2 having flanges 42, 44 connected to respective side surfaces 46, 48 of the panel units 2 via a respective leg 50, 52 cantilevered to an intermediate portion of the respective side surface 46, 48. The respective pair of flanges associated the same panel unit, such as 42, 46, project in opposite directions from the leg 50 to form a generally T-shaped joint. The respective flanges on juxtaposed panel units may be secured by a connector 36 having slanting legs, or by a connector 54, provided with means for engaging detents made in the flanges 56, 58, as known per se. The flanges 42, 44, 46 and 58 may or may not project from the planes of the major surfaces.

Figure 5:
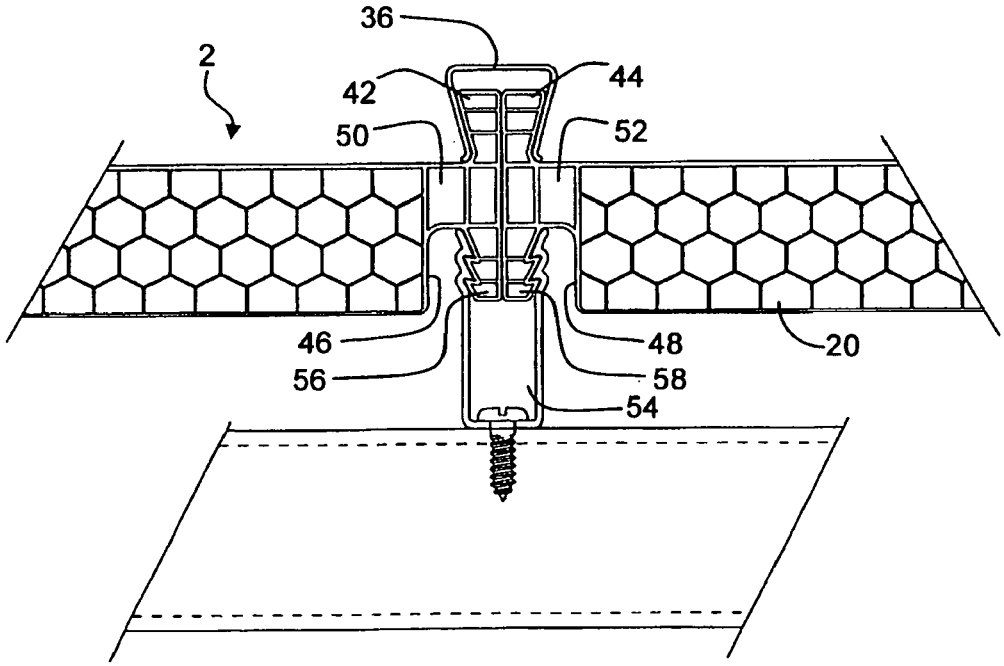

FIG. 5 shows a similar embodiment to that described with reference to FIG. 4, where the legs 50, 52 are connected at an edge of the end surfaces 46, 48 of the panel unit 2, in this case, at the upper edge, and extend flush with the major surfaces 4 of the two juxtaposed panel units 2. Thus, as seen, flanges 42, 44 project from the major surfaces 4, while flanges 56, 58 do not project from the plane connecting surfaces 4', but remain within the thickness of the panel units 2.

Figure 6:
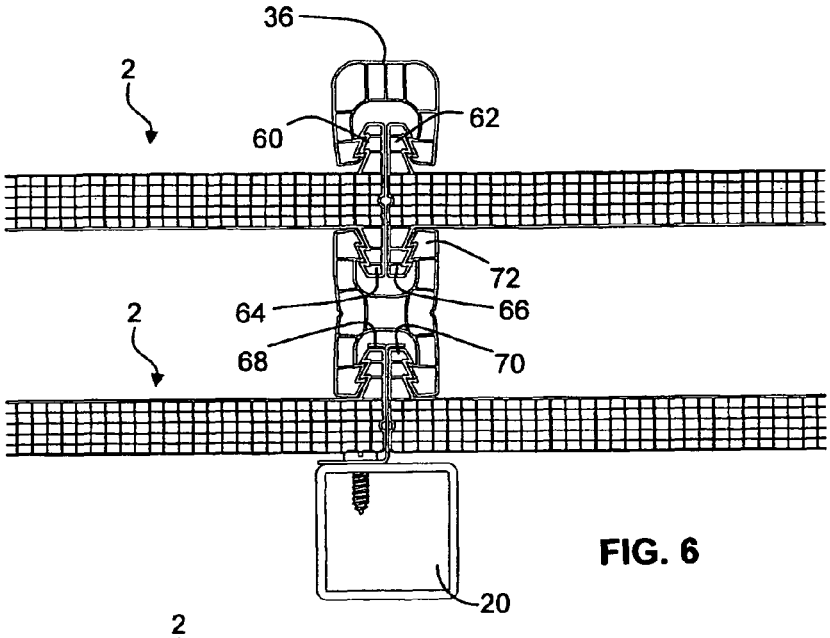
FIG. 6 is a cross-sectional view of a connected double panel structure, utilizing panel units according to embodiments of the present invention.

FIG. 6 shows an interconnected double panel unit structure wherein each of the panel units 2 has two oppositely extending flanges 60, 62, 64 and 66, enabling easy interconnection with a single flange panel unit 2 having flanges 68, 70, by means of an "H"-connector 72.

Figure 7:
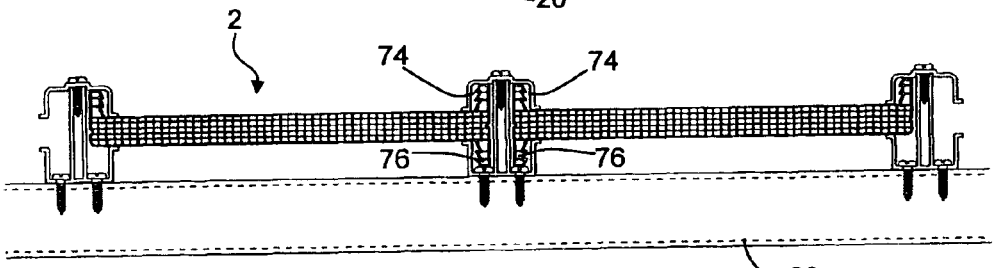
FIGS. 7 and 8 are cross-sectional views of two juxtaposed panel units, according to embodiments of the present invention, showing two edges thereof.
Figure 8:
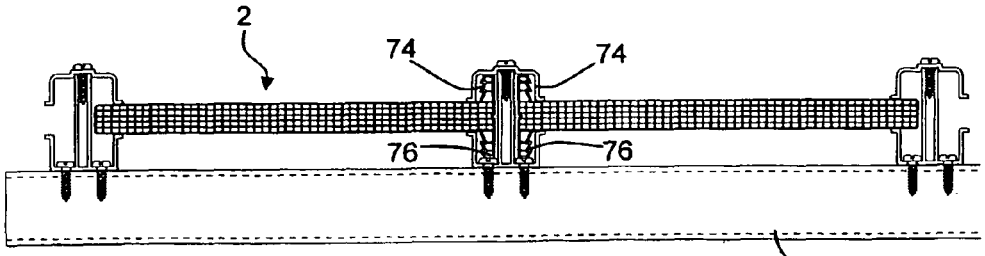

FIG. 7 illustrates two juxtaposed panels 2 each having at, or adjacent to, one edge, two oppositely-projecting flanges 74, 76, while at the other edge of the panel 2 a single flange 78 projects. FIG. 8 shows a similar embodiment in which the panels 2 have at, or adjacent to, one edge two oppositely-projecting flanges 74, 76, while at the other panel edge, there is no flange at all. Obviously, different types of connectors may be used to suit different configurations of panels and flanges, or lack of flanges.

Figure 9:
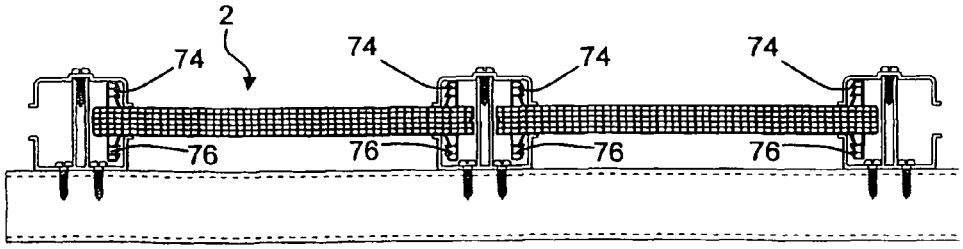
FIG. 9 is a cross-sectional view of two juxtaposed panel units, according to embodiments of the present invention, showing a panel in which the flanges are disposed adjacent to edges thereof.

FIG. 9 shows a panel unit 2 having flanges 74, 76 according to the invention disposed adjacent each edge of the panel unit. The distance between the edge and the flanges need not be symmetrical and can be determined as required.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

The invention claimed is:

1. A panel unit for constructional purposes, comprising a body portion and at least two joining flanges, said at least two joining flanges each projecting from opposite surfaces of a pair of outer surfaces of the body portion, said outer surfaces being configured such that a maximum distance between the outer surfaces defines a maximum thickness of the panel unit at a location adjacent or spaced from said joining flanges and said at least two joining flanges each being located at, or close to, a common end surface of the panel unit and projecting away from each other in mutually opposite directions, and said flanges being arranged such that at least one of the flanges projects outside said maximum thickness of the panel unit from a respective one of the outer surfaces, wherein the flanges projecting from at least one of the outer surfaces of the body portion have multiple detents on an outer surface configured for engaging and gripping compatible multiple detents in an internal surface of a female connector.

2. A structure comprising, in combination, a pair of juxtaposed panel units each including a body portion and at least two joining flanges each projecting from opposite surfaces of a pair of outer surfaces of the body portion, such that a maximum distance between the outer surfaces defines a maximum thickness of the panel unit at a location adjacent or spaced from said joining flanges, and a connector assembly for coupling the panel units, wherein the joining flanges are each located at, or close to, a common end surface of the panel unit such that at least one of the flanges on each panel unit projects outside said maximum thickness of the panel unit from a respective one of the outer surfaces, said connector assembly comprising a first female connector adapted for mounting over the flanges on a first surface of the panel units, and a second female connector adapted for mounting over the flanges on an opposite surface of the panel units, wherein at least one of the first female connector and the second female connector has multiple detents on an internal surface configured for engaging and gripping compatible multiple detents on an outer surface of the corresponding flanges.

3. A panel unit for constructional purposes, comprising a body portion having at least two joining flanges each projecting from first and second opposite surfaces of a pair of outer surfaces of the body portion, wherein for each point on the first opposite surface the panel unit has a thickness defined as a minimum distance between said point and the second opposite surface of the panel unit, and a maximum thickness of the panel unit is a maximum of the respective thicknesses of the panel unit for all points on said first opposite surface that do not overlap with a common side joining flange, said at least two joining flanges each being located at, or close to, a common end surface of the panel unit and projecting away from each other in mutually opposite directions so as to extend beyond said outer surfaces, such that a distance between respective tips of the at least two joining flanges exceeds the maximum thickness of the panel unit, and wherein each of said joining flanges includes a detent.

4. The panel unit according to claim 3, wherein at least one of said flanges projects normally with respect to one of said outer surfaces.

5. The panel unit according to claim 3, wherein at least one of said flanges projects at a non-normal angle with respect to one of said outer surfaces.

6. The panel unit according to claim 3, wherein two or more flanges project from a common surface.

7. The panel unit according to claim 3, wherein the flanges have slanting inner surfaces for engaging complementary panel connector slanting legs.

8. The panel unit according to claim 3, wherein the flanges are connected to an end surface of the panel unit via a leg cantilevered to the end surface of the panel unit.

9. The panel unit according to claim 8, wherein the flanges project in opposite directions from the leg to form a generally T-shaped joint.

10. The panel unit according to claim 8, wherein the leg is attached to an intermediate portion of the end surface of the panel unit.

11. The panel unit according to claim 8, wherein the leg is attached at an edge of the end surface of the panel unit.

12. The panel unit according to claim 3, wherein each of the flanges projecting from both of the outer surfaces of the body portion have multiple detents on an outer surface configured for engaging and gripping compatible detents in an internal surface of a female connector.

13. The panel unit according to claim 3, wherein each of said two joining flanges has a tip spaced from a respective, supporting one of said outer surfaces, with the respective outer surfaces being positioned between said tips and each of said two joining flanges projects outside said maximum thickness of the panel unit.

14. The panel unit according to claim 3, wherein the end surface of the panel unit forms a continuous surface with an outer surface of the opposing joining flanges.

15. The panel unit according to claim 3, wherein the panel unit is an extrusion.

16. The panel unit of claim 3, wherein at least one detent comprises a slanted surface in said joining flange configured to provide for a dovetail connection.

17. A structure comprising, in combination, a pair of said panel units of claim 3, wherein said panel units are juxtaposed, and a connector assembly for coupling the panel units, said connector assembly comprising:

a first female connector adapted for mounting over the flanges on a first surface of the panel units, and a second female connector adapted for mounting over the flanges on an opposite surface of the panel units.

18. The structure according to claim 17, wherein the first female connector is adapted for fixedly attaching to a structural element.

19. The structure according to claim 17, wherein the first female connector is adapted for anchoring to the second female connector.

20. The structure according to claim 19, wherein a cylindrical bore of height substantially equal to a combined height of the panel unit plus the opposing flanges projects upwards from a center of an internal surface of the second female connector.

21. The structure according to claim 20, wherein the first female connector is anchored to the second female connector via a screw that engages an internal thread of the cylindrical bore.

22. The structure according to claim 21, wherein the screw is self-tapping.

23. The structure according to claim 19, wherein the second female connector and the cylindrical bore are dimensioned such as to leave a gap between an outer surface of the bore and the end surfaces of the panel units so as to allow for thermal expansion and contraction of the panel units.

24. The structure according to claim 17, wherein at least one of the first female connector and the second female connector has detents on an internal surface configured for engaging and gripping compatible detents on an outer surface of the corresponding flanges.

25. The structure according to claim 17, wherein the first female connector and the second female connector are each provided on a respective internal surface with detents configured for engaging and gripping compatible detents on an outer surface of the corresponding flanges.

26. A panel unit for constructional purposes, comprising a body portion having at least two joining flanges each projecting from first and second opposite surfaces of a pair of outer surfaces of the body portion, wherein for each point on the first opposite surface the panel unit has a thickness defined as a minimum distance between said point and the second opposite surface of the panel unit, and a maximum thickness of the panel unit is a maximum of the respective thicknesses of the panel unit for all points on said first opposite surface that do not overlap with a common side joining flange, said at least two joining flanges each being located at, or close to, a common end surface of the panel unit and projecting away from each other in mutually opposite directions so as to extend beyond said outer surfaces, such that a distance between respective tips of the at least two joining flanges exceeds the maximum thickness of the panel unit, and wherein both of a pair of reference planes that (i) extend through respective maximum distance defining points in said first and second opposite surfaces and (ii) are normal to a line extending between the respective maximum distance defining points, fall between the respective tips relative to a direction of joining flange extension.

27. The panel unit according to claim 26, wherein said flanges each have at least one detent on an outer surface configured for engaging and gripping compatible detents in an internal surface of a female connector.

28. The panel unit according to claim 26, wherein the flanges are integrally extruded with the body portion as to define a panel unit extrusion with integrated flanges and body portion.

29. A connector for coupling respective joining flanges of first and second parallel panel structures, each panel structure comprising a pair of the panel units of claim 26, with the first and second panel structures each having mutually juxtaposed panel units, said connector comprising:

a body portion having opposite first and second ends, a first female receptacle formed within the first end of the body portion and being adapted for mounting over the respective mutually adjacent flanges of a juxtaposed pair of panel units in the first panel structure; and a second female receptacle formed within the second end of the body portion and being adapted for mounting over the respective mutually adjacent flanges of a pair of juxtaposed panel units in the second panel structure.

* * * * *